US010907814B1

(12) United States Patent
Tang et al.

(10) Patent No.: US 10,907,814 B1
(45) Date of Patent: Feb. 2, 2021

(54) LIGHTING STRUCTURE

(71) Applicant: Yi-Wen Tang, Taichung (TW)

(72) Inventors: Yi-Wen Tang, Taichung (TW); Jerry Cravens, Jr., Algonquin, IL (US)

(73) Assignee: Yi-Wen Tang, Taichung (TW)

( * ) Notice: Subject to any disclaimer, the term of this patent is extended or adjusted under 35 U.S.C. 154(b) by 0 days.

(21) Appl. No.: 16/902,863

(22) Filed: Jun. 16, 2020

(51) Int. Cl.

| | |
|---|---|
| ***F21V 21/30*** | (2006.01) |
| ***F21S 8/06*** | (2006.01) |
| *F21Y 103/10* | (2016.01) |
| *F21Y 115/10* | (2016.01) |

(52) U.S. Cl.
CPC ..... *F21V 21/30* (2013.01); *F21S 8/06* (2013.01); *F21Y 2103/10* (2016.08); *F21Y 2115/10* (2016.08)

(58) Field of Classification Search
CPC ..... F21V 21/30; F21S 8/06; F21Y 2103/10
See application file for complete search history.

(56) References Cited

U.S. PATENT DOCUMENTS

| | | | | |
|---|---|---|---|---|
| 3,936,671 | A * | 2/1976 | Bobrick | F21V 21/14 362/459 |
| 4,097,919 | A * | 6/1978 | Bobrick | 362/270 |
| 2009/0105002 | A1* | 4/2009 | Kahn | A63G 9/12 472/118 |
| 2017/0159907 | A1* | 6/2017 | Dyson | F21V 7/16 |
| 2018/0160891 | A1* | 6/2018 | Ahearn | F21S 8/066 |

* cited by examiner

*Primary Examiner* — Evan P Dzierzynski
(74) *Attorney, Agent, or Firm* — Muncy, Geissler, Olds & Lowe, P.C.

(57) ABSTRACT

A lighting structure is provided, including a base, a moving mechanism and at least two elongate lighting assemblies. The moving mechanism is connected with the base and the at least two elongate lighting assemblies. The moving mechanism is swingable and rotatable relative to the base.

10 Claims, 14 Drawing Sheets

LIGHTING STRUCTURE

BACKGROUND OF THE INVENTION

Field of the Invention

The present invention relates to a lighting structure.

Description of the Prior Art

The invention of light bulbs allows people to move at night without restriction. There are various types of light bulbs such as conventional T8 fluorescent lamps, T5 lamps, LEDs, energy saving bulbs, etc., and several types of lamps are developed to meet various requirements; ceiling lamps, semi-ceiling lamps, pendant lamps, downlights, wall lamps, for instance.

However, conventional lamps are used according to factory-set position and appearance, and positions and irradiation angles of bulbs of the lamps cannot be adjusted, which cannot meet using requirements.

The present invention is, therefore, arisen to obviate or at least mitigate the above-mentioned disadvantages.

SUMMARY OF THE INVENTION

The main object of the present invention is to provide a lighting structure having lighting assemblies which are adjustable in position and irradiation angle, which can meet various requirements.

To achieve the above and other objects, the present invention provides a lighting structure, including: a base, a moving mechanism and at least two elongate lighting assemblies. The base includes a seat portion and a lamp cap. The seat portion has a connecting surface and a working surface opposite to each other in a reference axial direction of the base, and the lamp cap is disposed on the connecting surface. The moving mechanism includes at least two swinging members and at least two rotating members, and a number of the at least two swinging members is equal to a number of the at least two rotating members. Each of the at least two swinging members is disposed on the seat portion and swingable between a first position and a second position relative to the seat portion about a swinging axis. Each of the at least two rotating members is disposed on one of the at least two swinging members and rotatable about a rotation axis. Each said swinging axis is transverse to the reference axial direction, and each said rotation axis is transverse to at least one said swinging axis. Each of the at least two elongate lighting assemblies is disposed on one of the at least two rotating members and extends along one said rotation axis. When the at least two swinging members are located in the first position, the at least two elongate lighting assemblies protrude beyond the connecting surface; when the at least two swinging members are located in the second position, the at least two elongate lighting assemblies protrude beyond the working surface.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
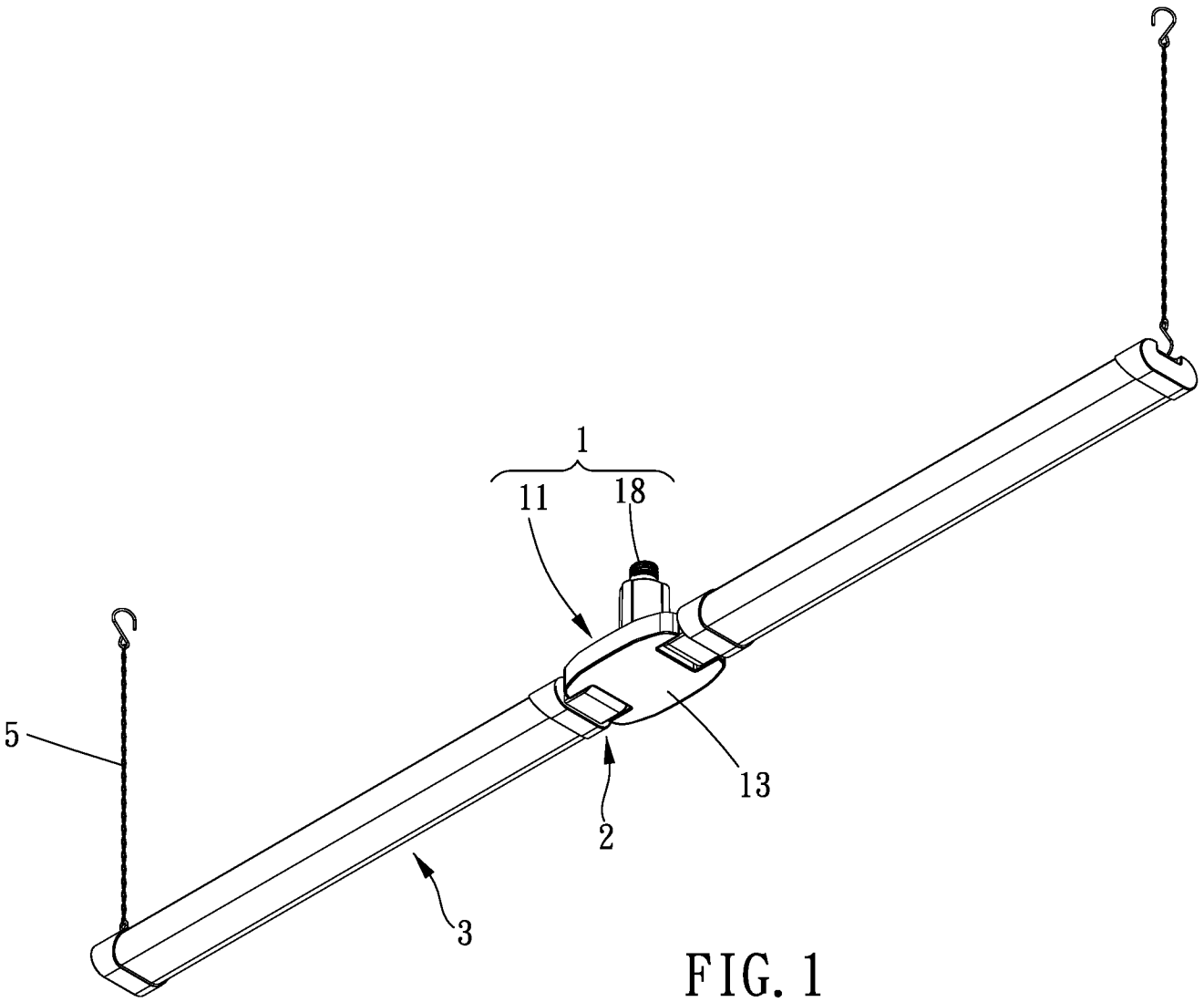
FIG. 1 is a stereogram of a preferable embodiment of the present invention.
Figure 2:
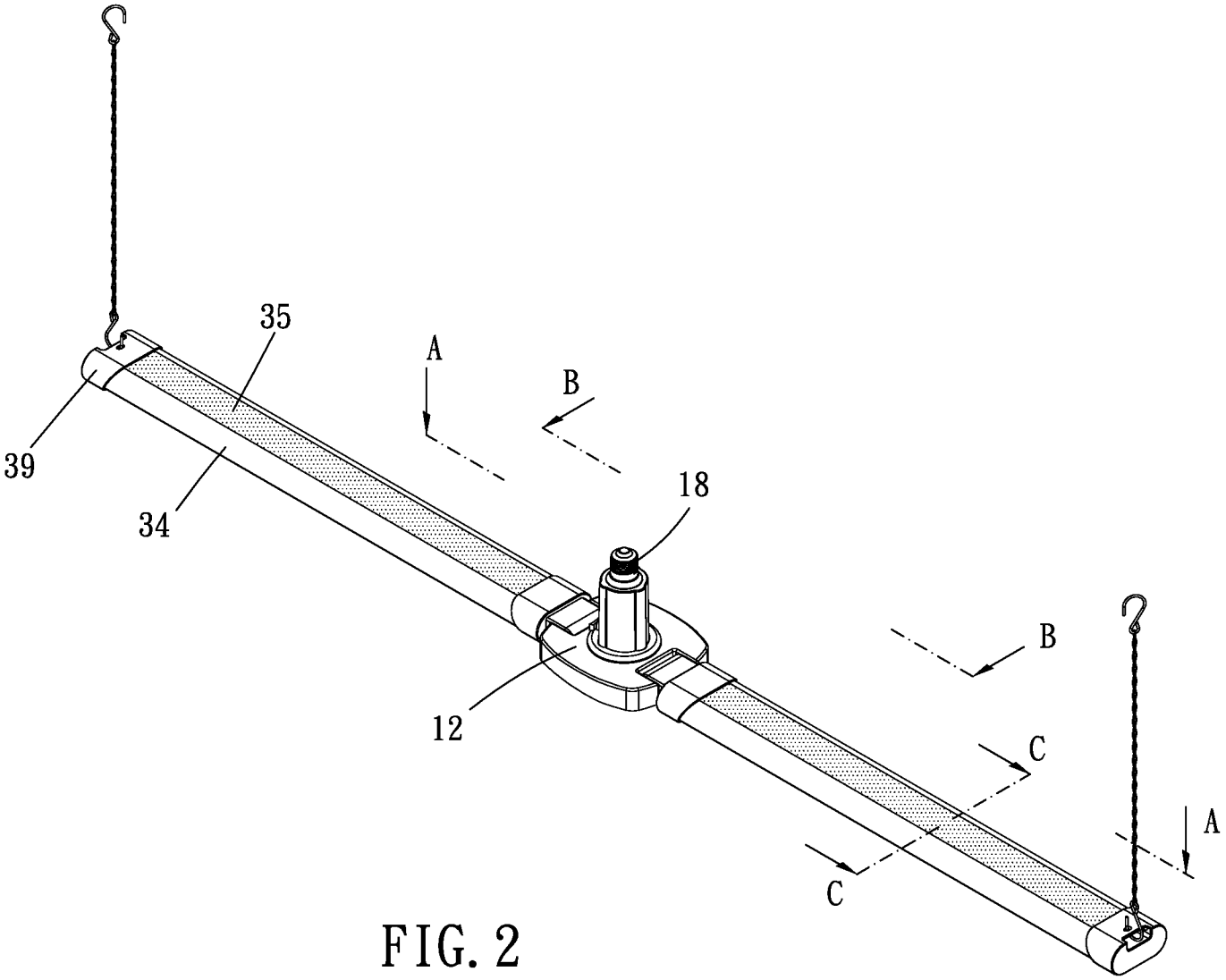
FIG. 2 is another stereogram of a preferable embodiment of the present invention.
Figure 3:
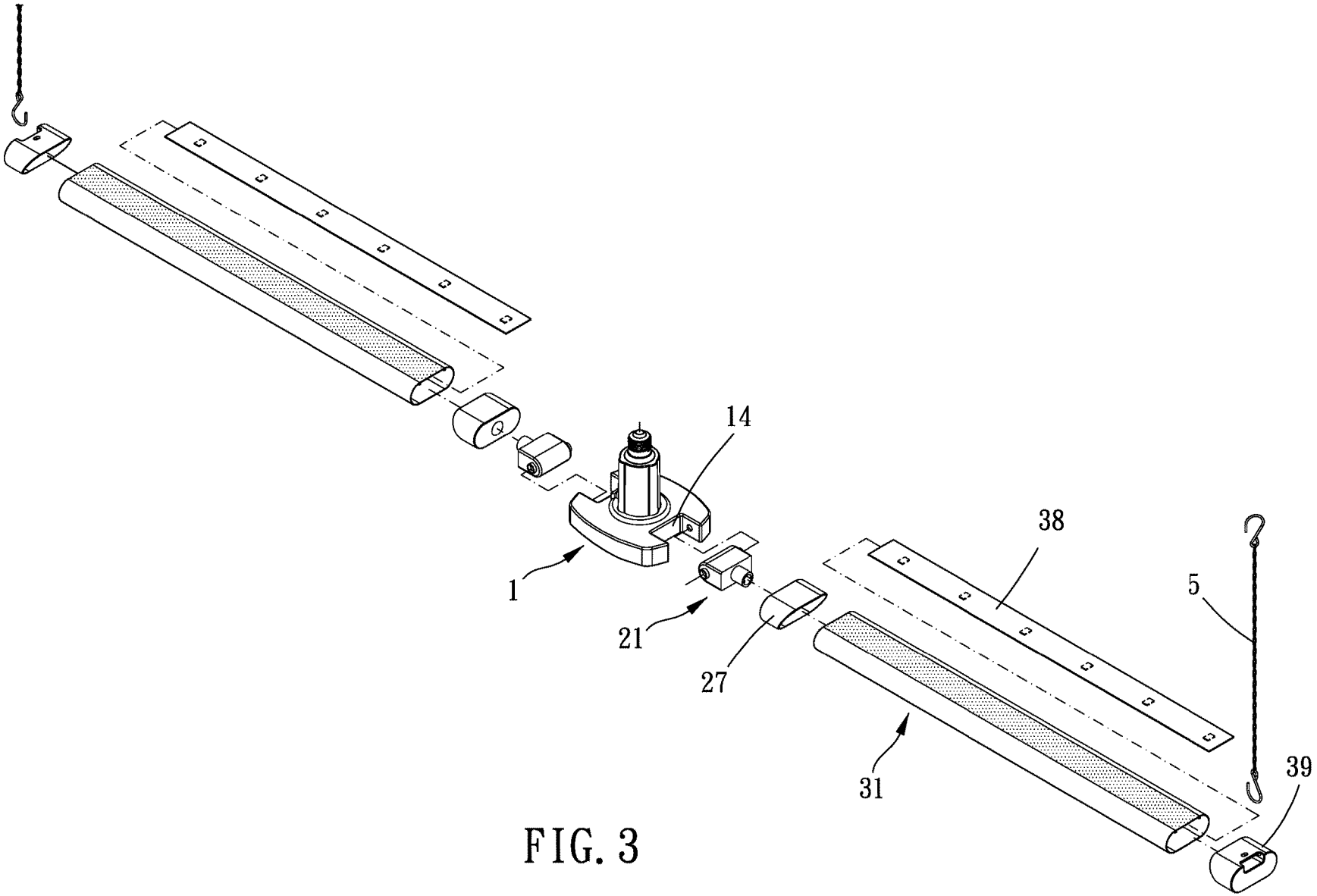
FIG. 3 is a breakdown drawing of FIG. 2.
Figure 4:
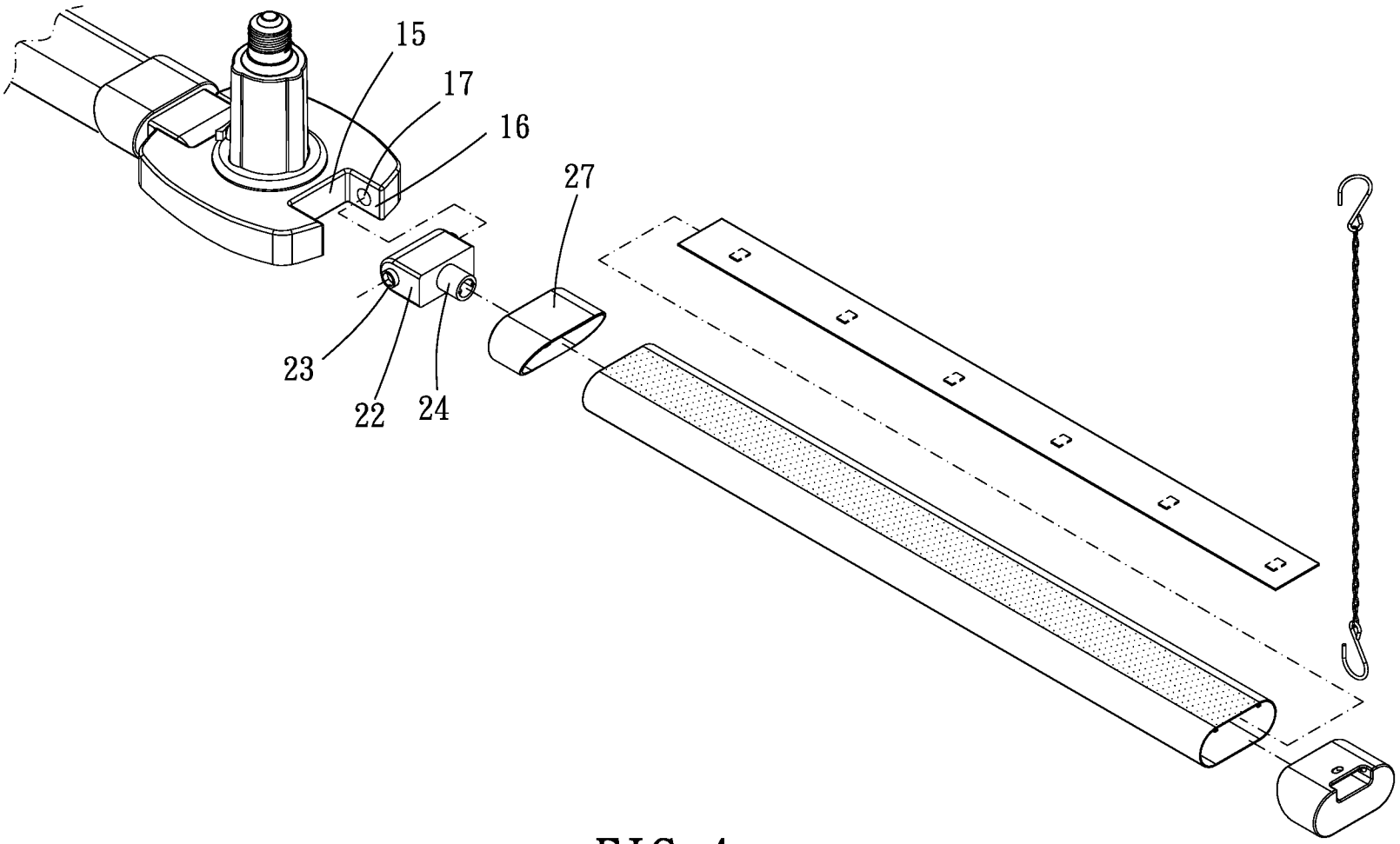
FIG. 4 is a partial enlargement of FIG. 3.
Figure 5:
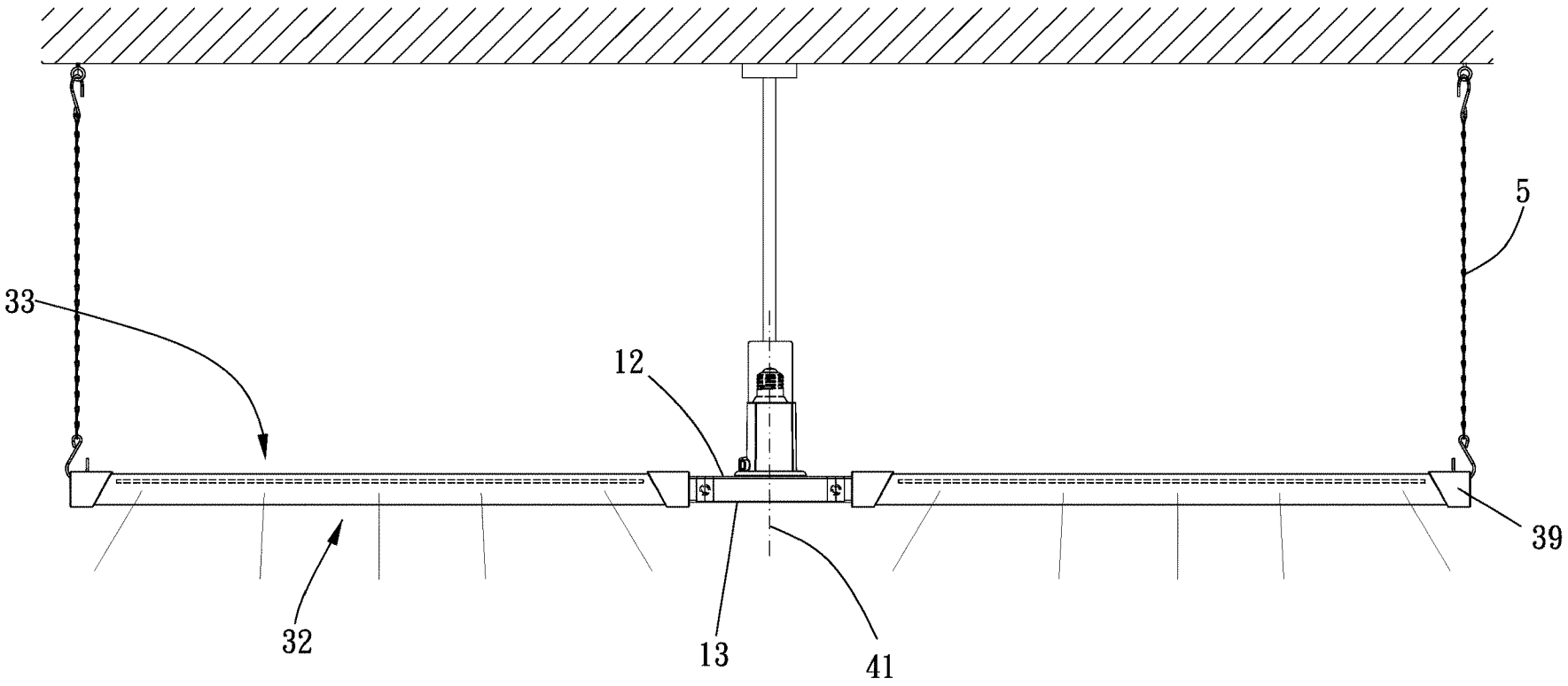
FIG. 5 is a schematic diagram of a preferable embodiment of the present invention in use.
Figure 6:
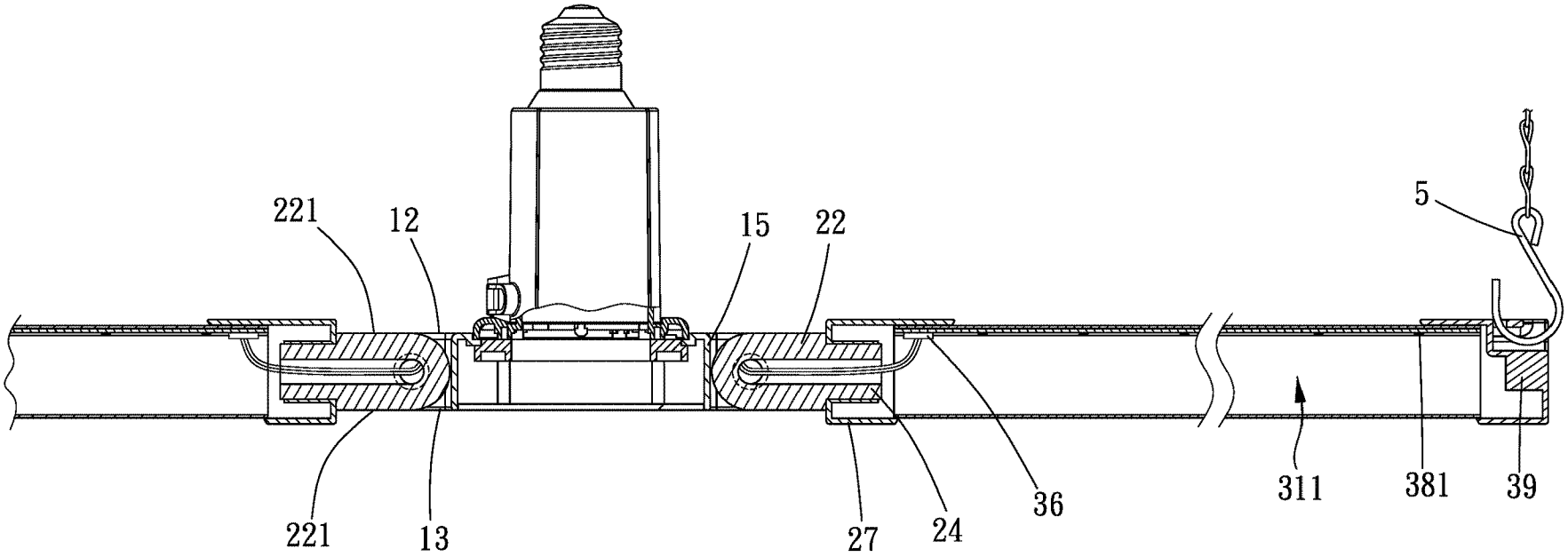
FIG. 6 is a partial cross-sectional side view of a preferable embodiment of the present invention.
Figure 7:
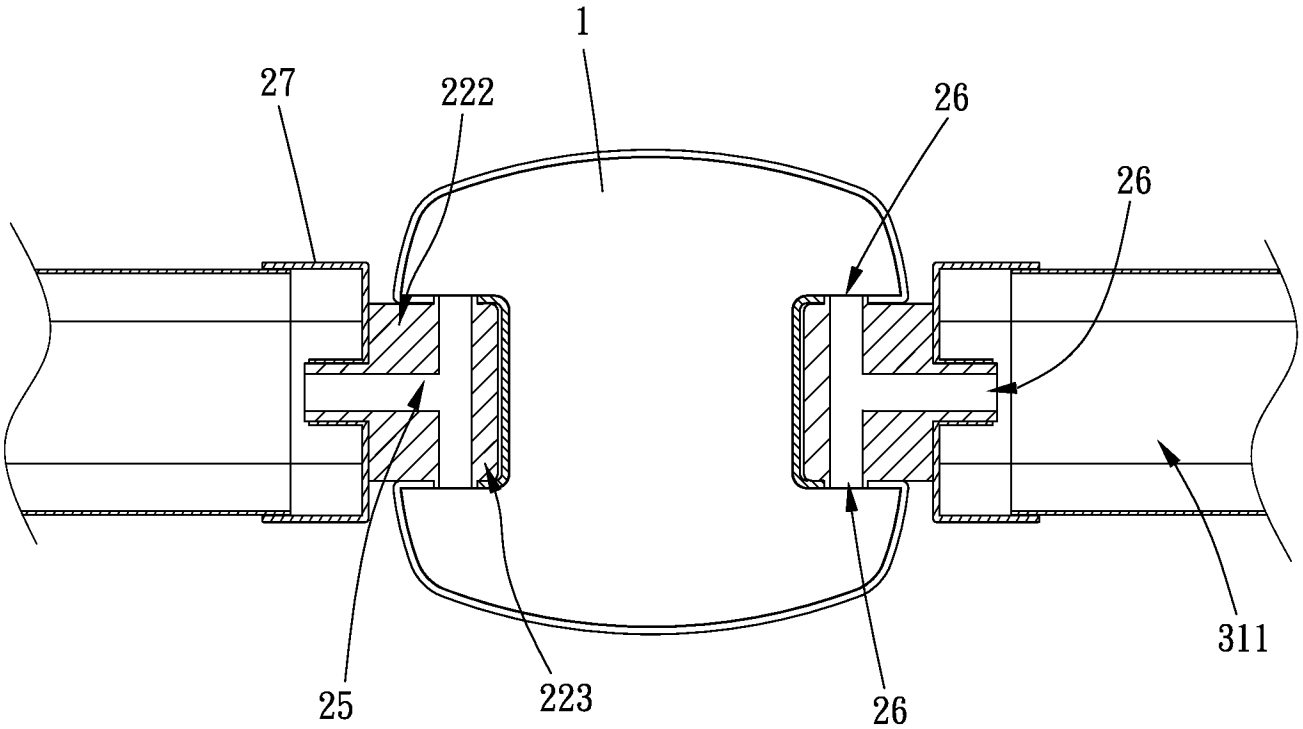
FIG. 7 is a partial cross-sectional top view of a preferable embodiment of the present invention.
Figure 8:
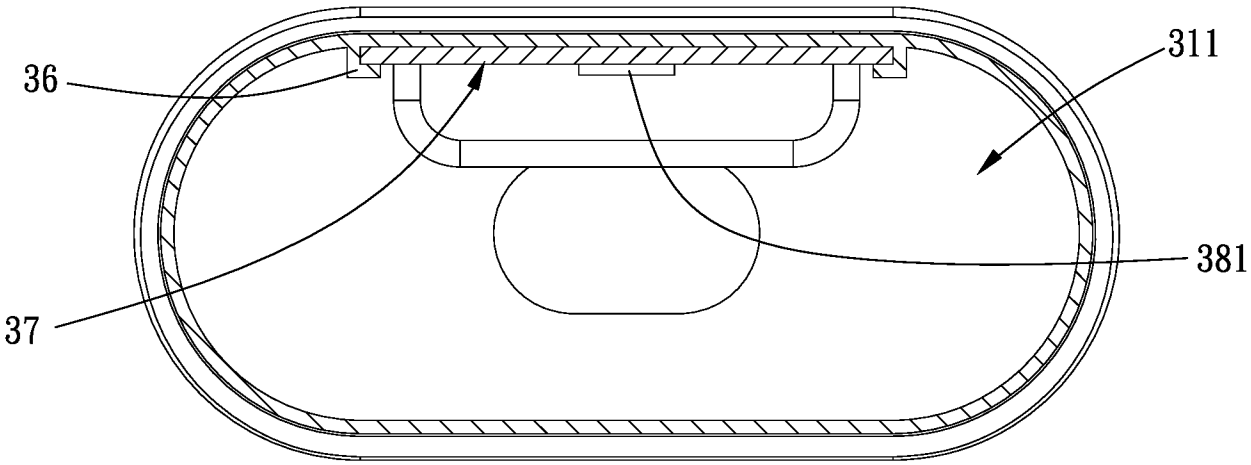
FIG. 8 is a cross-sectional view of an elongate lighting assembly of a preferable embodiment of the present invention.

Please refer to FIGS. 1 to 13 for a preferable embodiment of the present invention. A lighting structure of the present invention includes: a base 1, a moving mechanism 2 and at least two elongate lighting assemblies 3.

The base 1 includes a seat portion 11 and a lamp cap 18. The seat portion 11 has a connecting surface 12 and a working surface 13 opposite to each other in a reference axial direction 41 of the base 1, and the lamp cap 18 is disposed on the connecting surface 12. The moving mechanism 2 includes at least two swinging members 21 and at least two rotating members 27, and a number of the at least two swinging members 21 is equal to a number of the at least two rotating members 27. Each of the at least two swinging members 21 is disposed on the seat portion 11 and swingable between a first position and a second position relative to the seat portion 11 about a swinging axis 42. Each of the at least two rotating members 27 is disposed on one of the at least two swinging members 21 and rotatable about a rotation axis 43. Each said swinging axis 42 is transverse to the reference axial direction 41, and each said rotation axis 43 is transverse to at least one said swinging axis 42. Each of the at least two elongate lighting assemblies 3 is disposed on one of the at least two rotating members 27 and extends along one said rotation axis 43. When the at least two swinging members 21 are located in the first position, the at least two elongate lighting assemblies 3 protrude beyond the connecting surface 12; when the at least two swinging members 21 are located in the second position, the at least two elongate lighting assemblies 3 protrude beyond the working surface 13.

Figure 9:
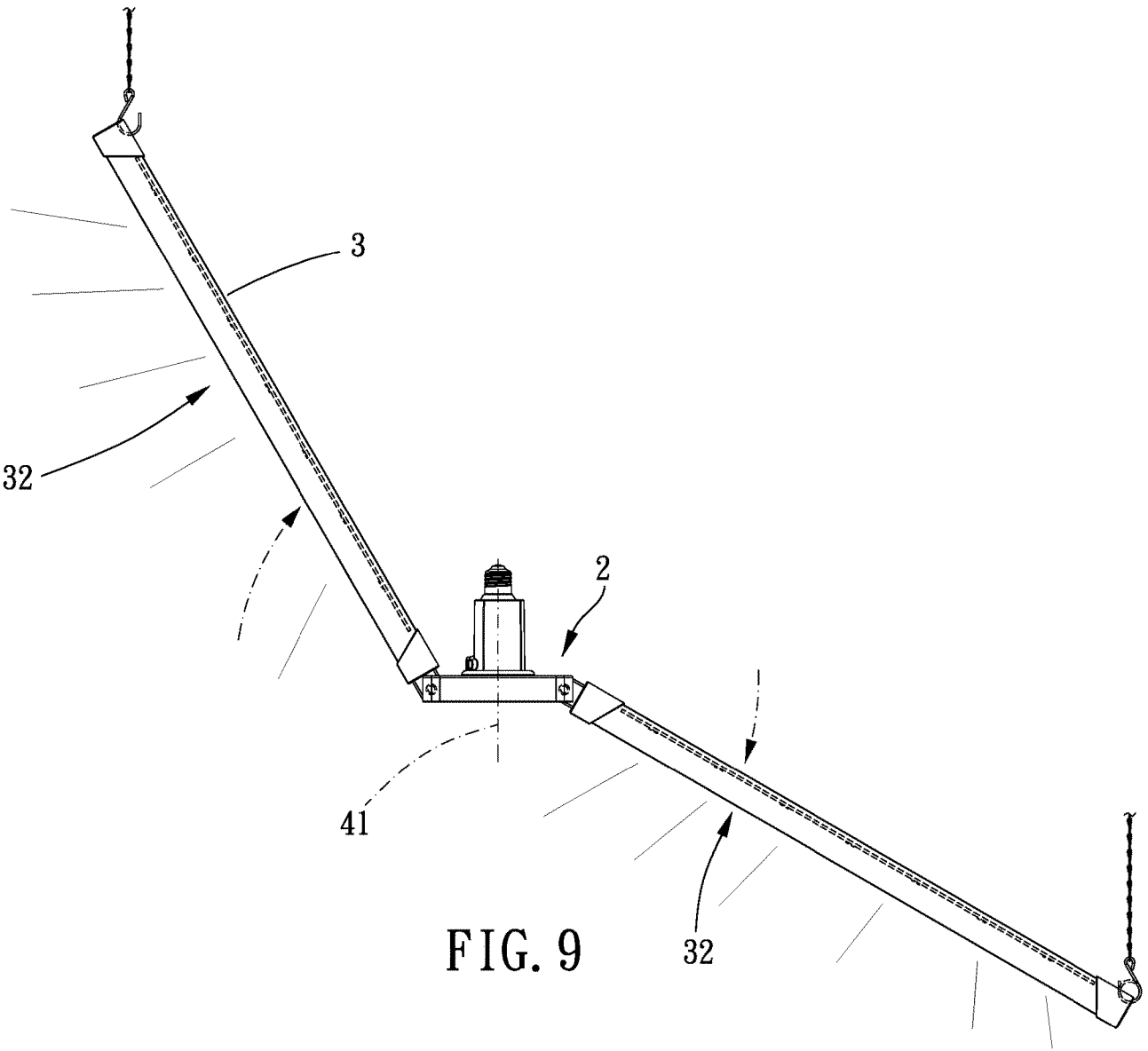
FIG. 9 is a schematic diagram showing operation of swinging members of a preferable embodiment of the present invention.
Figure 10:
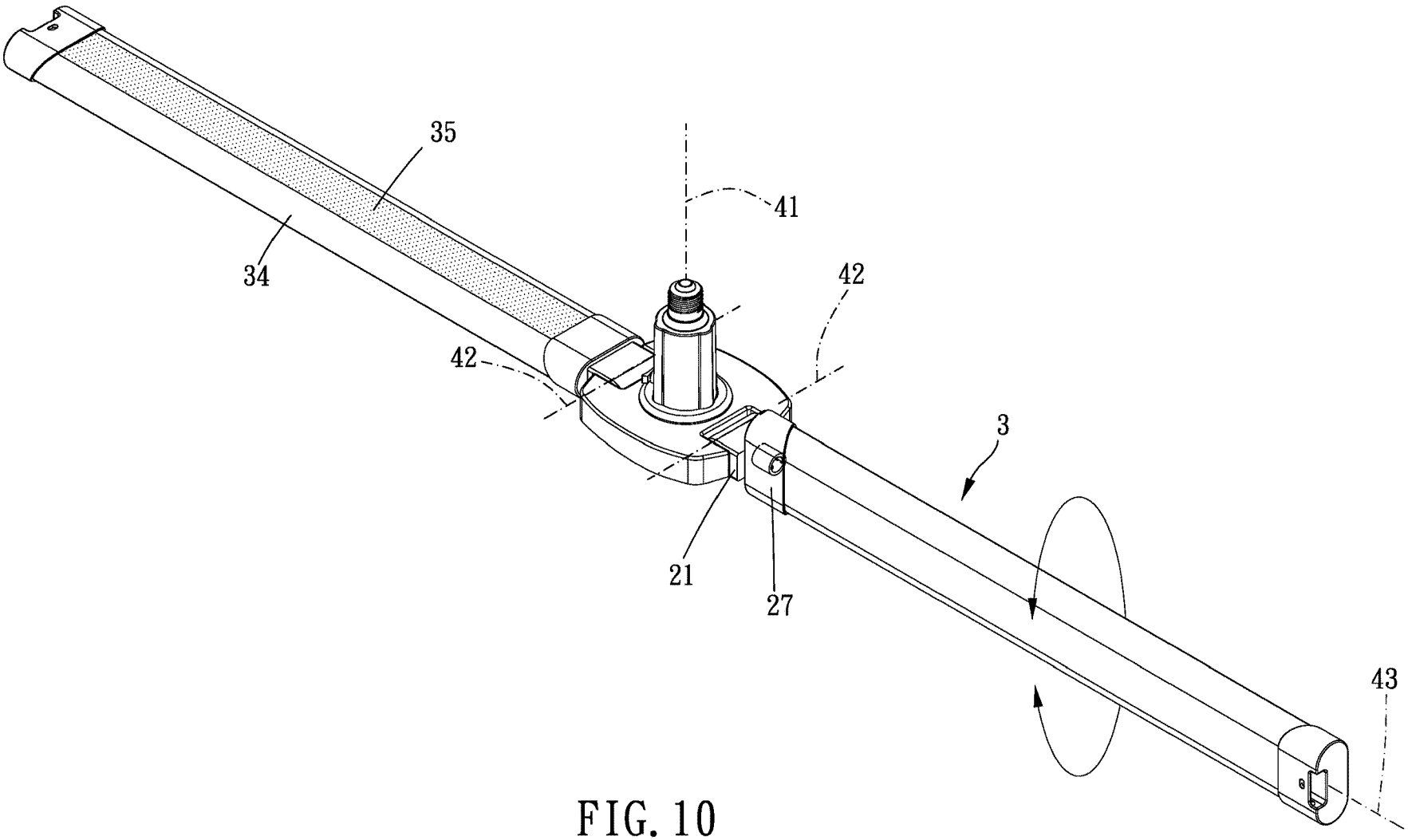
FIG. 10 is a schematic diagram showing operation of rotating members of a preferable embodiment of the present invention.
Figure 11:
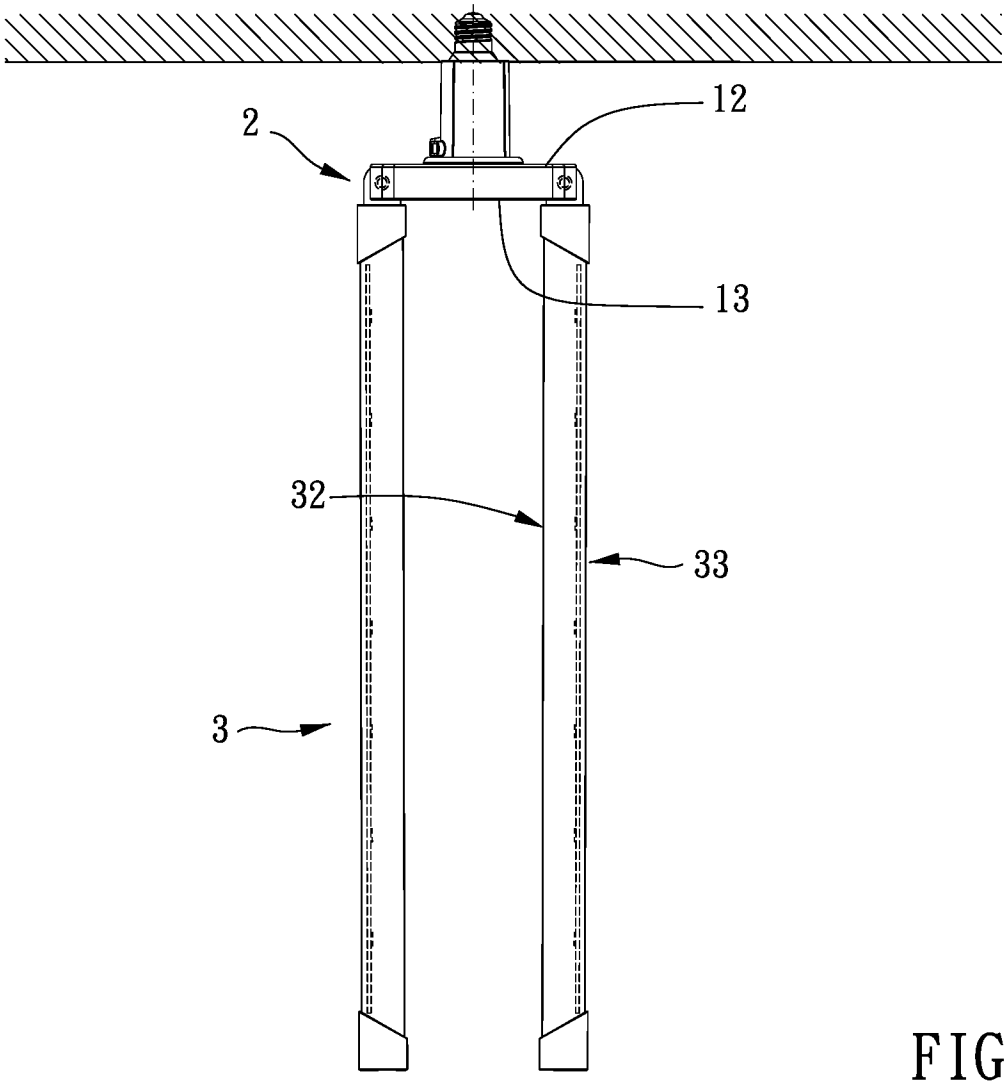
FIG. 11 is a schematic diagram of a preferable embodiment of the present invention when the swinging members are located in a second position.

Preferably, the number of the at least two swinging members 21 is even, and the at least two swinging members 21 are symmetrically arranged centering on the lamp cap 18 so as to provide uniform illumination. In this embodiment, numbers of the at least two swinging members 21, the at least two rotating members 27 and the at least two elongate lighting assemblies 3 are two, respectively. As shown in FIG. 9, positions of the at least two elongate lighting assemblies 3 are adjustable by the moving mechanism 2 so as to provide various irradiation angles; as shown in FIG. 1, the at least two elongate lighting assemblies 3 extend straight so as to be used as conventional fluorescent lamps.

Figure 14:
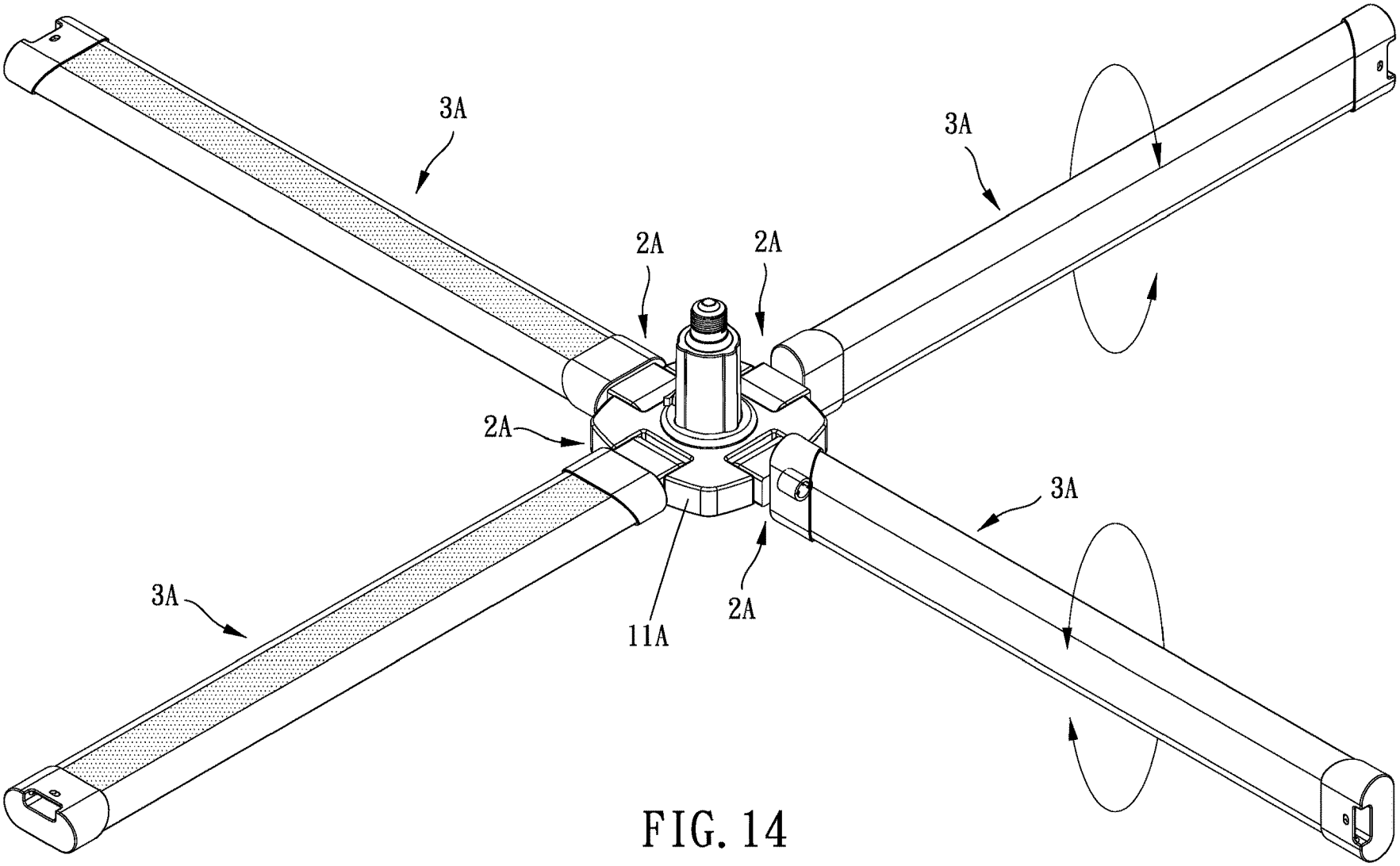
FIG. 14 is a stereogram of another preferable embodiment of the present invention.

Please refer to FIG. 14 showing another embodiment of the present invention. The seat portion 11A has four said moving mechanisms 2A respectively connected with four said elongate lighting assemblies 3A, which increases diversification of irradiation angles and positions of light sources so as to meet various using requirements.

Please refer to the embodiment of the present invention as shown in FIGS. 1 to 13. Specifically, each of the at least two elongate lighting assemblies 3 includes a lamp housing 31, a plurality of positioning members 36 and a LED light board 38. Each said lamp housing 31 is disposed on one of the at least two rotating members 27 and defines a light emitting side 32 and an assembling side 33 which are opposite to each other and an inner space 311. Each said inner space 311 is communicated with an interior of one of the at least two rotating members 27. Each said positioning member 36 is located in one said inner space 311 and at the assembling side 33 to define a groove 37 within which one said LED light board 38 is disposed, and each said LED light board 38 includes a plurality of LEDs 381 face toward the light emitting side 32 of one said lamp housing 31.

Moreover, the lamp housing 31 includes a light transmitting area 34 and an opaque area 35 connected with each other. Each said opaque area 35 is an elongate flat and entirely located at one said assembling side 33, and each said light transmitting area 34 is a C-shaped column and extends from one said light emitting side 32 to one said assembling side 33 so that light emitted from the plurality of LEDs 381 of each said LED light board 38 is transmittable through one said light emitting side 32 and one said assembling side 33 so as to provide a broad range of illumination.

Preferably, each of the at least two elongate lighting assemblies 3 further includes a hooked member 39 disposed on the lamp housing 31 thereof and configured to be hooked by a hook member 5 so as to increase stability of each of the at least two elongate lighting assemblies 3. In this embodiment, each said hooked member 39 is sleeved with an end of one said lamp housing 31 remote from one of the at least two rotating members 27 and is configured to block one said inner space 311 from external space, which effectively blocks dust, insects and other debris from entering the inner space 311 so as to have preferable illumination effect.

The seat portion 11 includes at least two swinging grooves 14 (a number of the at least two swinging grooves 14 is two in this embodiment), and the at least two swinging members 21 are swingably received within the at least two swinging grooves 14. Each of the at least two swinging grooves 14 includes a first groove wall 15 and two second groove walls 16 which extend face to face and perpendicularly relative to one said swinging axis 42 from two sides of the first groove wall 15. Each said second groove wall 16 has a through hole 17 disposed therethrough and open toward an extending direction of one said swinging axis 42. Each of the at least two swinging members 21 includes a main body 22 rotatably connected with one of the at least two rotating members 27 and two protruding portions 23 each protruding from the main body 22 and rotatably inserted within one said through hole 17. When one of the at least two swinging members 21 is located in the first position or the second position, one of two abutting surfaces 221 of one said main body 22 is abutted against one said first groove wall 15.

In this embodiment, the two protruding portions 23 of each said main body 22 are inserted within two said through holes 17 in tight fit for easy assembling and adjustment. A swingable angle of each of the at least two swinging members 21 between the first position and the second position is 180 degrees, which can meet various requirements of irradiation angles and positions and is convenient to storage and set the lighting structure.

Moreover, each of the at least two swinging members 21 further includes a three-way channel 25 and a rotating column 24 extending along one said rotation axis 43 and protruding from one said main body 22. Each of the at least two rotating members 27 is rotatably sleeved with one said rotating column 24, and three openings 26 of the three-way channel 25 are respectively disposed on the two protruding portions 23 and the rotating column 24 of one of the at least two swinging members 21 so as to communicate an interior of the base 1 with an interior of one of the at least two rotating members 27. Therefore, the three-way channel 25 allows wires to penetrate therethrough and electrically connect the lamp cap 18 with each said LED light board 38. In this embodiment, each of the at least two rotating members 27 is sleeved with one said rotating column 24 for rapid assembling; a maximum rotation angle of each of the at least two rotating members 27 relative to one of the at least two swinging members 21 is 240 degrees so that each of the at least two elongate lighting assemblies 3 are rotatable in a wide range.

Figure 12:
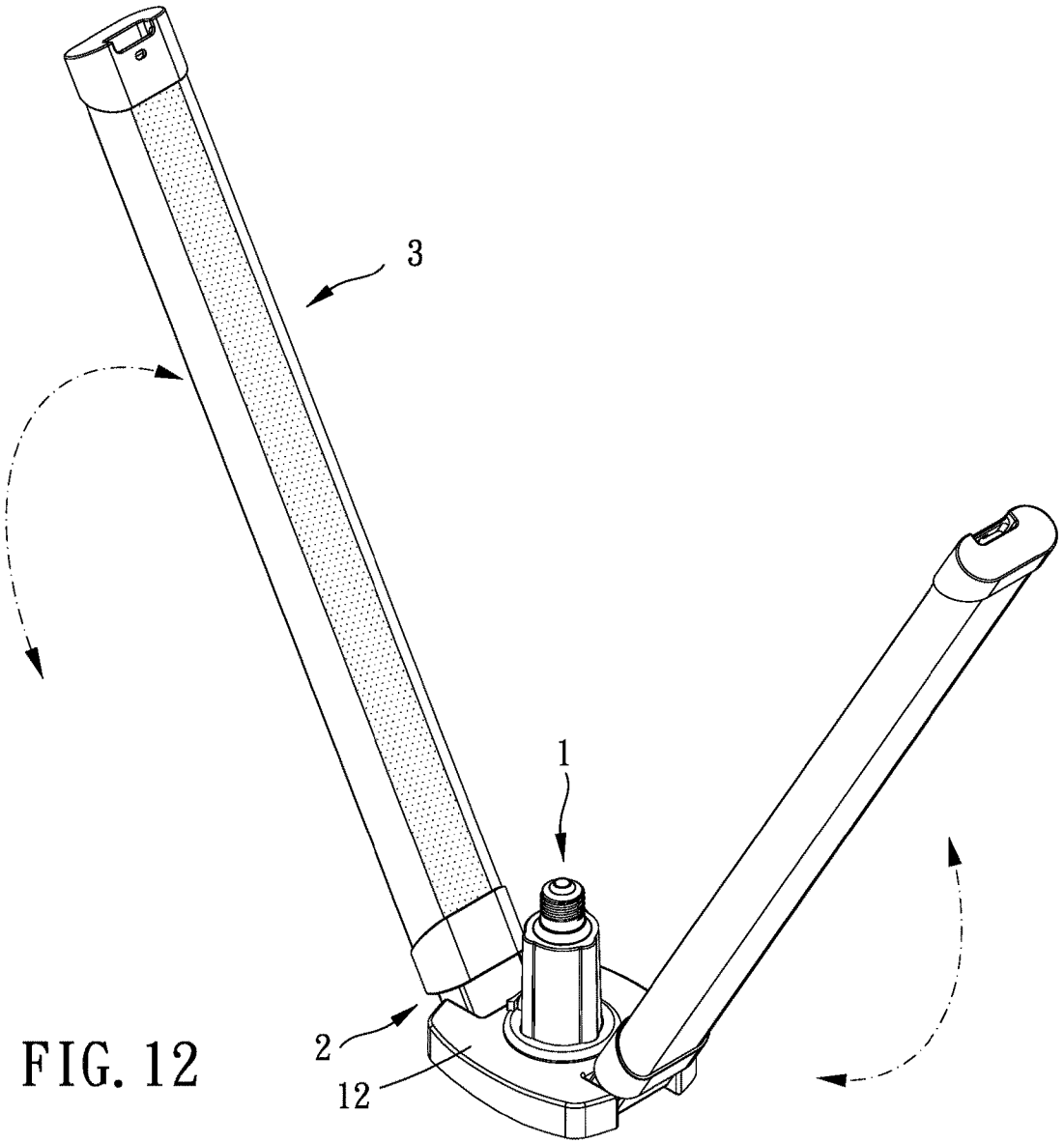
FIG. 12 is another schematic diagram of a preferable embodiment of the present invention in use.
Figure 13:
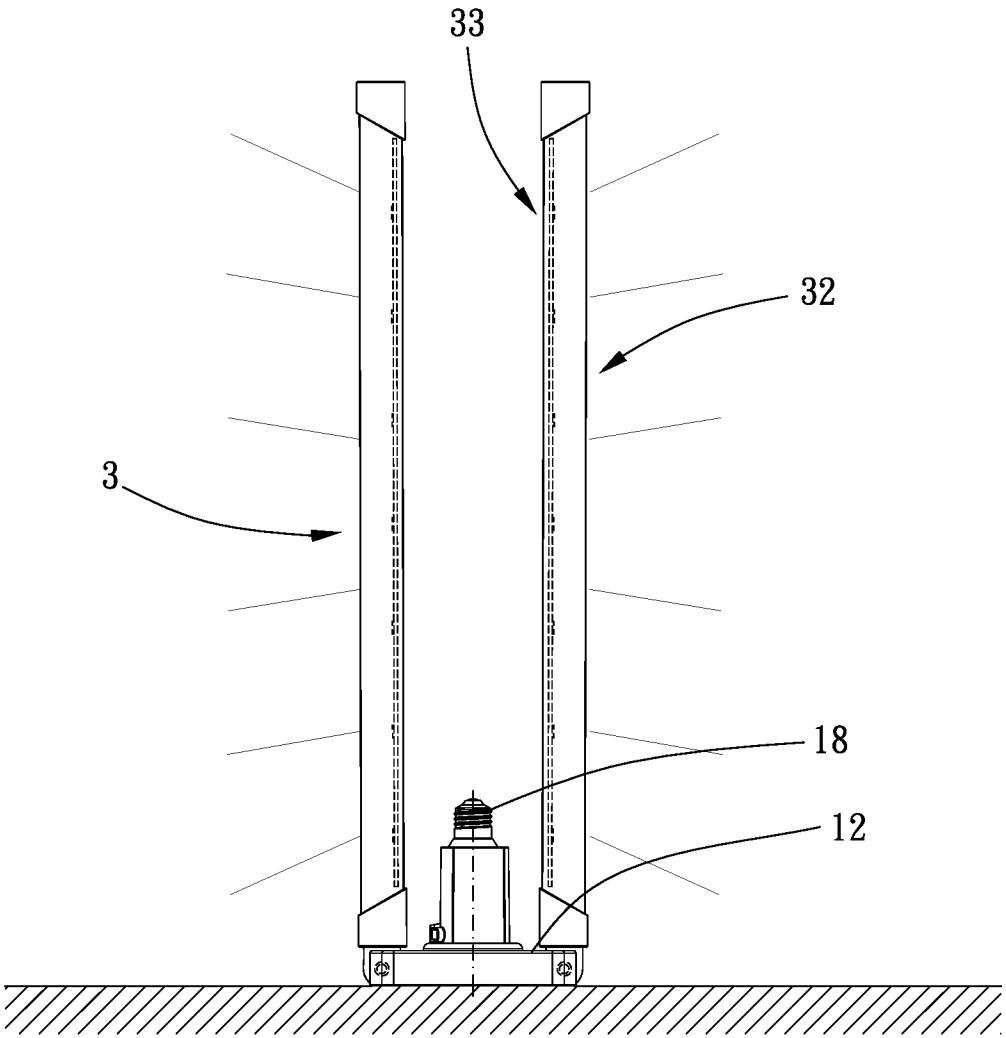
FIG. 13 is a schematic diagram of a preferable embodiment of the present invention when the swinging members are located in a first position.

The connecting surface 12 and the working surface 13 are parallel to each other, and the two abutting surfaces 221 of each said main body 22 are parallel to each other. A distance between the two abutting surfaces 221 of each said main body 22 is equal to or smaller than a distance between the connecting surface 12 and the working surface 13 so that each said main body 22 does not protrude beyond the seat portion 11, which protects each said main body 22 from unexpected collision. Moreover, each said main body 22 defines an upper portion 222 and a lower portion 223 relative to the two protruding portions 23 disposed thereon. When the at least two swinging members 21 are swinging between the first position and the second position, each said lower portion 223 is entirely located in one of the at least two swinging grooves 14, and the working surface 13 is a flat. Therefore, the lighting structure can be stably place on a plane, and the at least two elongate lighting assemblies 3 are swung upwardly and protrude beyond the connecting surface 12 to be used as a ground lamp, as shown in FIG. 12.

In summary, the lighting structure of the present invention is adjustable in illumination position by swinging and rotation and is hangable to illuminate downwardly or placed on a plane to illuminate around or upwardly so as to meet various requirements.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lighting structure, including:

a base, including a seat portion and a lamp cap, the seat portion having a connecting surface and a working surface opposite to each other in a reference axial direction of the base, the lamp cap being disposed on the connecting surface;

a moving mechanism, including at least two swinging members and at least two rotating members, a number of the at least two swinging members being equal to a number of the at least two rotating members, each of the at least two swinging members being disposed on the seat portion and swingable between a first position and a second position relative to the seat portion about a swinging axis, each of the at least two rotating members being disposed on one of the at least two swinging members and rotatable about a rotation axis, each said swinging axis being transverse to the reference axial direction, each said rotation axis being transverse to at least one said swinging axis; and at least two elongate lighting assemblies each disposed on one of the at least two rotating members and extending along one said rotation axis;

wherein when the at least two swinging members are located in the first position, the at least two elongate lighting assemblies protrude beyond the connecting surface; when the at least two swinging members are located in the second position, the at least two elongate lighting assemblies protrude beyond the working surface.

2. The lighting structure of claim 1, wherein each of the at least two elongate lighting assemblies includes a lamp housing, a plurality of positioning members and a LED light board, each said lamp housing is disposed on one of the at least two rotating members and defines a light emitting side and an assembling side which are opposite to each other and an inner space, each said positioning member is located in one said inner space and at the assembling side to define a groove within which one said LED light board is disposed, and each said LED light board includes a plurality of LEDs face toward the light emitting side of one said lamp housing.

3. The lighting structure of claim 2, wherein each of the at least two elongate lighting assemblies further includes a hooked member disposed on the lamp housing thereof and configured to be hooked by a hook member.

4. The lighting structure of claim 3, wherein each said hooked member is sleeved with an end of one said lamp housing remote from one of the at least two rotating members and is configured to block one said inner space from external space.

5. The lighting structure of claim 4, wherein the number of the at least two swinging members is even; the at least two swinging members are symmetrically arranged centering on the lamp cap; the seat portion includes at least two swinging grooves, the at least two swinging members are swingably received within the at least two swinging grooves, each of the at least two swinging grooves includes a first groove wall and two second groove walls which extend face to face and perpendicularly relative to one said swinging axis from two sides of the first groove wall, each said second groove wall has a through hole disposed therethrough and open toward an extending direction of one said swinging axis, each of the at least two swinging members includes a main body rotatably connected with one of the at least two rotating members and two protruding portions each protruding from the main body and rotatably inserted within one said through hole; when one of the at least two swinging members is located in the first position or the second position, one of two abutting surfaces of one said main body is abutted against one said first groove wall; each of the at least two swinging members further includes a three-way channel and a rotating column extending along one said rotation axis and protruding from one said main body, each of the at least two rotating members is rotatably sleeved with one said rotating column, three openings of each said three-way channel are respectively disposed on the two protruding portions and the rotating column of one of the at least two swinging members so as to communicate an interior of the base with an interior of one of the at least two rotating members; the connecting surface and the working surface are parallel to each other, the two abutting surfaces of each said main body are parallel to each other; a distance between the two abutting surfaces of each said main body is equal to or smaller than a distance between the connecting surface and the working surface; the working surface is a flat; numbers of the at least two swinging members, the at least two rotating members and the at least two elongate lighting assemblies are two, respectively; each said lamp housing includes a light transmitting area and an opaque area connected with each other, each said opaque area is an elongate flat and entirely located at one said assembling side, each said light transmitting area is a C-shaped column and extends from one said light emitting side to one said assembling side; each of the at least two rotating members is sleeved with one said rotating column in tight fit; the two protruding portions of each said main body are inserted within two said through holes in tight fit; a swingable angle of each of the at least two swinging members between the first position and the second position is 180 degrees; a maximum rotation angle of each of the at least two rotating members relative to one of the at least two swinging members is 240 degrees.

6. The lighting structure of claim 1, wherein the number of the at least two swinging members is even.

7. The lighting structure of claim 6, wherein the at least two swinging members are symmetrically arranged centering on the lamp cap.

8. The lighting structure of claim 1, wherein the seat portion includes at least two swinging grooves, the at least two swinging members are swingably received within the at least two swinging grooves, each of the at least two swinging grooves includes a first groove wall and two second groove walls which extend face to face and perpendicularly relative to one said swinging axis from two sides of the first groove wall, each said second groove wall has a through hole disposed therethrough and open toward an extending direction of one said swinging axis, each of the at least two swinging members includes a main body rotatably connected with one of the at least two rotating members and two protruding portions each protruding from the main body and rotatably inserted within one said through hole; when one of the at least two swinging members is located in the first position or the second position, one of two abutting surfaces of one said main body is abutted against one said first groove wall.

9. The lighting structure of claim 8, wherein each of the at least two swinging members further includes a three-way channel and a rotating column extending along one said rotation axis and protruding from one said main body, each of the at least two rotating members is rotatably sleeved with one said rotating column, three openings of each said three-way channel are respectively disposed on the two protruding portions and the rotating column of one of the at least two swinging members so as to communicate an interior of the base with an interior of one of the at least two rotating members.

10. The lighting structure of claim 9, wherein the connecting surface and the working surface are parallel to each other, the two abutting surfaces of each said main body are parallel to each other; a distance between the two abutting surfaces of each said main body is equal to or smaller than a distance between the connecting surface and the working surface; each said main body defines an upper portion and a lower portion relative to the two protruding portions disposed thereon; when the at least two swinging members are swinging between the first position and the second position, each said lower portion is entirely located in one of the at least two swinging grooves.

* * * * *